US009410310B1

(12) United States Patent
Eckert et al.

(10) Patent No.: US 9,410,310 B1
(45) Date of Patent: Aug. 9, 2016

(54) VERTICALLY AND HORIZONTALLY ADJUSTABLE SINK SYSTEM FOR USE BY PERSONS USING A WHEELCHAIR AND/OR A WALKER

(71) Applicants: Gene Eckert, Hamburg, NJ (US); Stephen Derby, Troy, NY (US); David Brown, Pittsford, NY (US)

(72) Inventors: Gene Eckert, Hamburg, NJ (US); Stephen Derby, Troy, NY (US); David Brown, Pittsford, NY (US)

( * ) Notice: Subject to any disclaimer, the term of this patent is extended or adjusted under 35 U.S.C. 154(b) by 221 days.

(21) Appl. No.: 14/474,838

(22) Filed: Sep. 2, 2014

Related U.S. Application Data

(60) Provisional application No. 61/959,841, filed on Sep. 3, 2013.

(51) Int. Cl.
*A47K 1/05* (2006.01)
*E03C 1/32* (2006.01)
*E03C 1/18* (2006.01)

(52) U.S. Cl.
CPC ... *E03C 1/32* (2013.01); *E03C 1/18* (2013.01); *A47K 1/05* (2013.01)

(58) Field of Classification Search
CPC ..... E03C 1/328
USPC ..... 4/619–660
See application file for complete search history.

(56) References Cited

U.S. PATENT DOCUMENTS 1,385,262 A * 7/1921 Nebel ..... E03C 1/328 4/645
1,406,426 A * 2/1922 Stewart ..... E03C 1/328 4/645
1,864,184 A * 6/1932 Cavert ..... E03C 1/324 4/645
3,118,147 A * 1/1964 Larkin ..... E03C 1/18 4/645
5,050,253 A * 9/1991 Wasek ..... E03C 1/328 4/645
5,230,109 A * 7/1993 Zaccai ..... E03C 1/324 4/643
5,628,075 A * 5/1997 Dudnik ..... E03C 1/324 4/645
5,867,847 A * 2/1999 Klawitter ..... E03C 1/328 312/247
5,893,396 A * 4/1999 Vagle ..... E03C 1/324 138/120
6,360,381 B1 * 3/2002 Fitzgerald, Sr. ..... E03D 11/143 248/68.1
6,820,290 B1 * 11/2004 Mullick ..... A47K 3/30 4/643
7,428,882 B2 * 9/2008 Keil ..... A61D 3/00 119/674
7,571,497 B2 * 8/2009 Hetzler ..... E03C 1/326 248/124.1
8,424,128 B2 * 4/2013 Dvorak ..... A47B 77/06 4/630
2002/0066141 A1 * 6/2002 Diaz Rivera ..... A47K 1/02 4/645
2005/0066438 A1 * 3/2005 Hong ..... E03C 1/328 4/645

OTHER PUBLICATIONS

An advertisement on the world wide web for a vertically adjustable sink avaiable under the brane name "APPROACH" by the Populas Furniture Company.
The advertisement is avaliable at the following URL address: http://www.populasfurniture.com/product/approach%e2%84%a2-adjustable-sink/.

* cited by examiner

*Primary Examiner* — Lori Baker
(74) *Attorney, Agent, or Firm* — Malcolm J. Chisholm, Jr.

(57) ABSTRACT

The sink system (10) includes a sink support frame (12) for supporting a sink (24). A vertical adjustment mechanism (30) secured between the sink support frame (12) and a rear wall (32) permits selective vertical movement of the sink support frame (12). A horizontal adjustment mechanism (40) secured between the sink support frame (12) and the sink (24) permits selective horizontal movement of the sink (24) away from and toward the rear wall (32). Flexible cold and hot water delivery lines (44, 46) and a flexible drain pipe (54) are secured between the rear wall (32) and a bottom surface of the sink. Vertical and horizontal movement of the sink (24) greatly facilitates use of the sink (24) by elderly and disabled persons using a wheelchair (56) and/or a walker. A two-sink cabinet embodiment (130) is also disclosed.

14 Claims, 10 Drawing Sheets

VERTICALLY AND HORIZONTALLY ADJUSTABLE SINK SYSTEM FOR USE BY PERSONS USING A WHEELCHAIR AND/OR A WALKER

CROSS-REFERENCE TO RELATED APPLICATIONS

This Application claims the benefit of U.S. Provisional Patent Application Ser. No. 61/959,841 that was filed on Sep. 3, 2013 entitled "Modular Adjustable Sink".

TECHNICAL FIELD

This disclosure relates to an adjustable sink for use by persons using wheelchairs or walkers, and in particular relates to a sink that is both vertically and horizontally adjustable.

BACKGROUND ART

It is increasingly common to design living quarters with a sensitivity to elderly and disabled persons. Many such persons are required to utilize wheelchairs and/or walkers to move from one location to another. (For purposes herein, the word "walker" is to mean an apparatus having rigid, vertical posts interconnected so that a person needing assistance in walking may lean on hand-grips at the top of the posts and move slowly along with the walker, like two interconnected canes disposed on either side of the person.) While wheelchairs and walkers greatly assist the mobility of elderly and disabled persons, use of wheelchairs and walkers within bathrooms or washrooms gives rise to significant limitations.

For example, a person sitting in a wheelchair and endeavoring to utilize a sink for cleansing is confronted with the problem of the sink being an inefficient horizontal distance away from the seated wheelchair user. Additionally, a standard construction height of an upper or working surface for bathroom sinks is most often thirty-six inches. However, persons using wheelchairs are frequently severely limited in their ability to move their upper torsos and have great difficulty using a sink having a set vertical height. Even worse, persons using a walker are almost invariably unable to lean forward a significant distance to efficiently use a fixed-position sink. Hence, such elderly and disabled persons are at risk of further injury and very difficult or inadequate cleansing as a result of known bathroom sinks.

Efforts have been made to produce vertically adjustable sinks to aid persons in wheelchairs. For example an "APPROACH" brand vertically adjustable sink is advertised by the POPULAS Furniture Company and can be seen on the internet at: http://www.populasfurniture.com/product/approach%e2%84%a2-adjustable-sink/ This sink, however does not help a user get closer to the sink on a horizontal plane. U.S. Pat. No. 8,424,128 that issued on Apr. 23, 2013 to Dvorak shows a "drawer containing a sink" for use in a larger sink cabinet structure as a small, limited use vegetable cleaning, or "veggie" sink. This sink, however, is constructed only for convenience in storing the small sink out of the way within the cabinet and has no capacity for use by persons with limited mobility in wheelchairs and/or walkers.

Accordingly, there is a need for a bathroom sink that facilitates cleansing by disabled or elderly persons using wheelchairs and/or walkers and that overcomes the deficiencies of known bathroom sinks

SUMMARY OF THE DISCLOSURE

The disclosure is a vertically and horizontally adjustable sink system that provides for substantial vertical and horizontal movement of a sink to accommodate varying needs of elderly or disabled persons using wheelchairs and walkers. The sink system includes a sink support frame that has a rear strut with a first edge and an opposed second edge at opposed perimeter edges of the rear strut. A first arm extends from the first edge of the strut in a direction away from the rear strut and a second arm similarly extends away from the second edge of the rear strut in direction parallel to the extension of the first arm. The rear strut, first arm and second arm are configured to support a sink within a plane about parallel to a plane defined by a planar, horizontal support surface below the sink support frame, such as a floor of a bathroom or kitchen.

The sink system also includes a vertical adjustment mechanism secured between the sink support frame and a rear wall. The rear wall defines an approximate vertical plane about perpendicular to and above the support surface or floor and may be adjacent the rear strut of the sink support frame. The vertical adjustment mechanism includes an adjustable vertical mechanical connector secured between the rear wall and the sink support frame and is configured to permit selective vertical movement of the sink support frame vertically up and down in an axis about parallel to the vertical plane of the rear wall. A horizontal adjustment mechanism is also secured between the sink support frame and the sink. The horizontal adjustment mechanism includes an adjustable horizontal mechanical connector that is secured between the sink support frame and the sink. The horizontal mechanical connector is also configured to permit selective horizontal movement of the sink away from and toward the rear strut along a plane about parallel to the plane defined by the planar, horizontal support surface below the sink support frame. The sink system also includes flexible cold and hot water delivery lines that are secured between the rear wall below the sink support frame and an inlet of at least one sink-top faucet. The inlet of the sink-top faucet is adjacent a bottom surface of the sink. Additionally, a flexible drain pipe is secured between a drain outlet in the bottom surface of the sink and the wall below the rear strut. (For purposes herein, the word "about" is to mean plus or minus ten percent.)

In one aspect of the disclosure, the vertical adjustment mechanism is configured so that an upper surface of the sink selectively extends through a vertical extension range about ten inches above and about ten inches below a construction standard height of about thirty-six inches above the horizontal support surface of floor below the sink. In this aspect, the sink is also configured so that whenever a back edge of the sink is adjacent the rear strut of the sink support frame, a front edge of the sink is within a vertical plane that defines a leading edge limit. The leading edge limit prohibits motion of a leading edge of a wheel chair or a walker beyond the leading edge limit toward the rear strut of the sink support frame. The plane defining the leading edge limit plane may be formed by cabinet doors, or other such structures extending below the front edge of the sink to the floor. In this aspect, the horizontal adjustment mechanism is configured so that a front edge of the sink selectively extends through a horizontal extension range about ten inches beyond the leading edge limit.

In another aspect of the disclosure, the vertical adjustment mechanism may be configured so that the upper surface of the sink selectively extends through the vertical extension range about twenty inches above and about twenty inches below the construction standard height of about thirty-six inches above the horizontal support surface. Similarly, the horizontal adjustment mechanism may be configured so that the front edge of the sink selectively extends through the horizontal extension range about twenty inches beyond the leading edge limit. In a further embodiment of the vertically and horizontally adjustable sink system, the vertical adjustment mechanism may be configured so that the upper surface of the sink selectively extends through the vertical extension range about thirty inches above and about thirty inches below the construction standard height of about thirty-six inches above the horizontal support surface. In yet another aspect, the horizontal adjustment mechanism may be configured so that the front edge of the sink also selectively extends through the horizontal extension range about thirty inches beyond the leading edge limit.

In an additional embodiment, the vertical adjustment mechanism is secured between the sink support frame and a rear wall of a sink-cabinet. In this type of embodiment, the vertically and horizontally adjustable sink system is integrated within a common bathroom vanity or kitchen cabinet and the vertical adjustment mechanism is anchored to a component of the cabinet, such as a rear wall of the cabinet.

In yet a further embodiment of the vertically and horizontally adjustable sink system the sink support frame may be one of two adjustable sinks integrated within one cabinet. In this embodiment the above-described sink support frame is a first sink support frame that is integrated within a two-sink cabinet. The two-sink cabinet includes a horizontal countertop that overlies the first sink support frame and first sink within the first frame. A portion of the horizontal countertop extends horizontally beyond the first sink support frame and defines a void for receiving and securing a second sink support frame that supports a second sink. A second vertical adjustment mechanism is secured between the second support frame and a frame component of the two-sink cabinet. The second vertical adjustment mechanism includes the elements of the vertical adjustment mechanism described above and in more detail below to permit selective vertical movement of the second sink support frame vertically up and down above the horizontal countertop. Additionally, a second horizontal adjustment mechanism is secured between the second sink support frame and the second sink. The second horizontal adjustment mechanism includes the elements of the horizontal adjustment mechanism described above and in more detail below to permit selective horizontal movement of the second sink away from and toward a rear wall of the two-sink cabinet whenever the vertical adjustment mechanism has positioned the second sink support frame above the horizontal countertop. This facilitates use of the second sink by a person using a walker.

In another aspect of the vertically and horizontally adjustable sink system within a two-sink cabinet, the flexible cold and hot water delivery lines and the flexible drain pipe secured between the rear wall below the first sink support frame are secured to the wall by quick disconnect fittings. This facilitates efficient installation and removal of the first sink and first sink frame for only a partial duration of use of the two-sink cabinet, such as when a washroom is used by a person confined to a wheelchair for a few years, and therebefore or thereafter it is desired to use the space in the cabinet for storage or other uses whenever the first sink support frame is removed from the two-sink cabinet.

The adjustable vertical mechanical connector and horizontal mechanical connectors may include any apparatus known in the art that can accomplish the described functions of vertically and horizontally adjusting positions of the first and second sink frames and the first and second sinks. For example, the vertical mechanical connector may include linear slides, threaded axle and screw mechanical linkages, or rack and pinion drives, etc. to vertically move the sink support frame as described above. Similarly, the horizontal mechanical connecter may include standard slides such as utilized in ordinary cabinet drawers, or other known horizontal adjustment apparatus that can accomplish the described functions. The vertical and horizontal mechanical connectors may also include electric-motors, hydraulic pumps, pneumatic compressors or combinations thereof, or other power generating apparatus with positioning sensor control systems to permit automated movement of the sink frames and sinks from a first position for non-disabled, young or short persons to second and/or other predetermined positions for elderly or disabled persons using wheelchairs and/or walkers. For example, a control switch near the sink frames may simply be actuated from a first position to a second position to adjust the sinks between first and second predetermined positions, wherein the predetermined positions are established to meet the needs of specific persons including those using wheelchairs and/or walkers.

Accordingly, it is a general purpose of the present disclosure to provide a vertically and horizontally adjustable sink system for use by persons using a wheelchair and/or a walker that overcomes deficiencies of the prior art.

This and other purposes and advantages of the present vertically and horizontally adjustable sink system for use by persons using a wheelchair and/or a walker will become more readily apparent when the following description is read in conjunction with the accompanying drawings.

PREFERRED EMBODIMENTS OF THE DISCLOSURE

Figure 1:
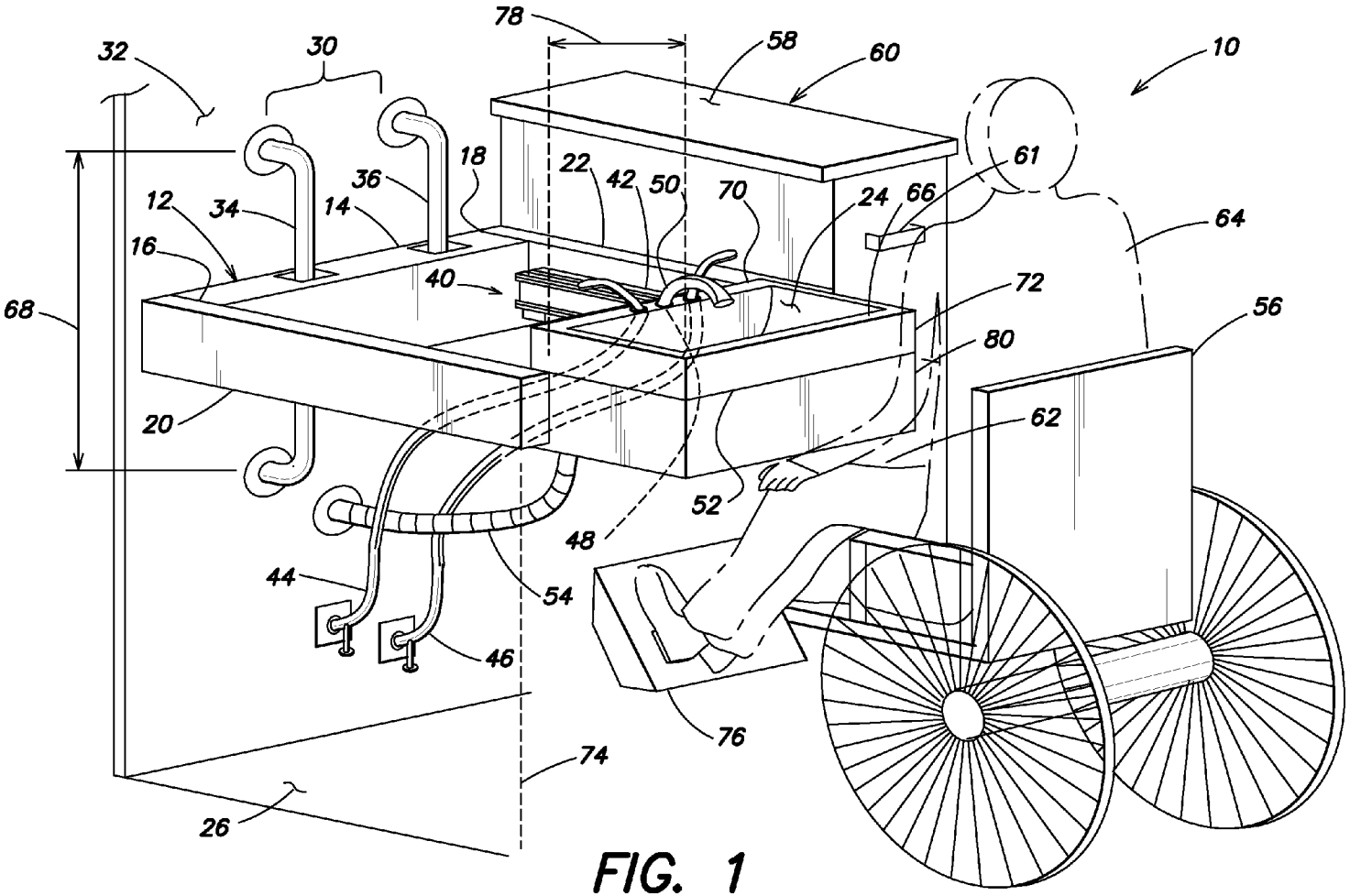
FIG. 1 is a fragmentary, raised perspective view of a vertically and horizontally adjustable sink system constructed in accordance with the present disclosure, showing a portion of a wheelchair adjacent a vertically and horizontally adjusted sink of the sink system.

Referring to the drawings in detail, a vertically and adjustable sink system for use by persons using a wheelchair and/or a walker is shown in FIG. 1, and is generally designated by the reference numeral 10. The sink system 10 includes a sink support frame 12 that has a rear strut 14 with a first edge 16 and an opposed second edge 18 at opposed perimeter edges of the rear strut 14. A first arm 20 extends from the first edge 16 of the strut 14 in a direction away from the rear strut 14 and a second arm 22 similarly extends away from the second edge 18 of the rear strut 14 in direction parallel to the extension of the first arm 20. The rear strut 14, first arm 20 and second arm 22 are configured to support a sink 24 within a plane about parallel to a plane defined by a planar, horizontal support surface 26 below the sink support frame 12, such as a floor 26 of a bathroom or kitchen (not shown).

The sink system 10 also includes a vertical adjustment mechanism 30 secured between the sink support frame 12 and a rear wall 32. The vertical adjustment mechanism shown in FIG. 1 includes a first slide-guide rail 34 and a second slide-guide rail 36, wherein the rails 34, 36 are secured to the rear wall 32 in parallel vertical alignment and also pass through the rear strut 14. The rails 34, 36 provide both guidance for vertical movement of the sink support frame 12 and structural strength or support to maintain the sink support frame 12 in about a horizontal plane as the frame 12 moves vertically. Many different types of power sources and drive mechanisms may be utilized to move the sink support frame 12 vertically up and down the slide-guide rails 34, 36. An exemplary vertical support mechanism 30 is shown in more detail in FIG. 2, and described with reference to FIG. 2 below and details an exemplary power source.)

The rear wall 32 defines an approximate vertical plane about perpendicular to and above the support surface or floor 26 and may be adjacent the rear strut 14 of the sink support frame 12. The vertical adjustment mechanism 30 includes an adjustable vertical mechanical connector, such as the first and second slide-guide rail 34, 36, secured between the rear wall 32 and the sink support frame 12. As described above, the adjustable first and second guide rails 34, 36 are powered to permit selective vertical movement of the sink support frame 12 vertically up and down in an axis about parallel to the vertical plane defined by the rear wall 32.

A horizontal adjustment mechanism 40 is also secured between the sink support frame 12 and the sink 24. The horizontal adjustment mechanism 40 may include standard cabinet slide bars 42 as an adjustable horizontal mechanical connector 42 that is secured between the sink support frame 12 and the sink 24. The horizontal mechanical connector 42 is also configured to permit selective horizontal movement of the sink 24 away from and toward the rear strut 24 along a plane about parallel to the plane defined by the planar, horizontal support surface floor 26 below the sink support frame 12. The sink system 10 also includes a flexible cold water delivery line 44 and a flexible hot water delivery line 46 that are secured between the rear wall 24 below the sink support frame 12 and an inlet 48 of at least one sink-top faucet 50. The inlet 48 of the sink-top faucet 50 is adjacent a bottom surface 52 of the sink 24. Additionally, a flexible drain pipe 54 is secured between the bottom surface 52 of the sink 24 and the wall 32 below the rear strut 14.

Also shown in FIG. 1 is a portion of a wheel chair 56 positioned so that the sink 24 is adjusted downward to be below an adjacent work surface 58 of a cabinet 60 and also properly positioned at the same vertical level as just above a lap 62 of a person 64 (shown only partially in FIG. 1) seated within the wheelchair 56. Additionally, the sink 24 is adjusted horizontally away from the rear strut 14 to be positioned over the lap 62 of the person 64 in the wheelchair 56 to facilitate efficient, safe and clean use of the sink 24.

In one aspect of the sink system 10, the vertical adjustment mechanism 30 is configured so that an upper surface 66 of the sink 24 selectively extends through a vertical extension range 68 of about ten inches above and about ten inches below a construction standard height of about thirty-six inches above the horizontal support surface or floor 26 below the sink 24. The work surface 58 of the cabinet 60 (having a drawer handle 61) of FIG. 1 schematically represents the construction standard height of about thirty-six inches above the floor 26. (It is noted that the slide-guide rails 34, 36 in FIG. 1 would in actuality extend further above the work surface 58 than as shown in the simplified drawing of FIG. 1)

In this FIG. 1 aspect, the sink 24 is also configured so that whenever a back edge 70 of the sink is adjacent the rear strut 14 of the sink support frame 12, a front edge 72 of the sink is within a vertical plane 74 that defines a leading edge limit 74. The leading edge limit 74 prohibits motion of a leading edge 76 (such as foot supports 27) of the wheel chair 56 or a walker (not shown) beyond the leading edge limit 74 toward the rear strut 14 of the sink support frame 12. The plane defining the leading edge limit 74 may be formed by cabinet doors (not shown in FIG. 1), or other such structures extending below the front edge 72 of the sink 24 to the floor 26. In this embodiment, the horizontal adjustment mechanism 40 is configured so that the front edge 72 of the sink selectively extends through a horizontal extension range 78 of about ten inches beyond the leading edge limit 74.

As described above in the Summary Section, in another aspect of the disclosure, the vertical adjustment mechanism 30 may be configured so that the upper surface 66 of the sink 24 selectively extends through the vertical extension range 68 about twenty inches above and about twenty inches below the construction standard height of about thirty-six inches above the horizontal support surface 26. Similarly, the horizontal adjustment mechanism 40 may be configured so that the front edge 72 of the sink 24 selectively extends through the horizontal extension range 78 about twenty inches beyond the leading edge limit 74. In a further embodiment of the vertically and horizontally adjustable sink system 10, the vertical adjustment mechanism 30 may be configured so that the upper surface 66 of the sink 24 selectively extends through the vertical extension range 68 about thirty inches above and about thirty inches below the construction standard height of about thirty-six inches above the horizontal support surface 26. In yet another aspect, the horizontal adjustment mechanism 40 may be configured so that the front edge 72 of the sink 24 also selectively extends through the horizontal extension range 78 about thirty inches beyond the leading edge limit 74. In FIG. 1, the sink 24 is shown as integrated with a sink support box 80 to facilitate securing the sink 24 and supporting box 80 to the sink support frame 12, and horizontal adjustment mechanism 40.

Figure 2:
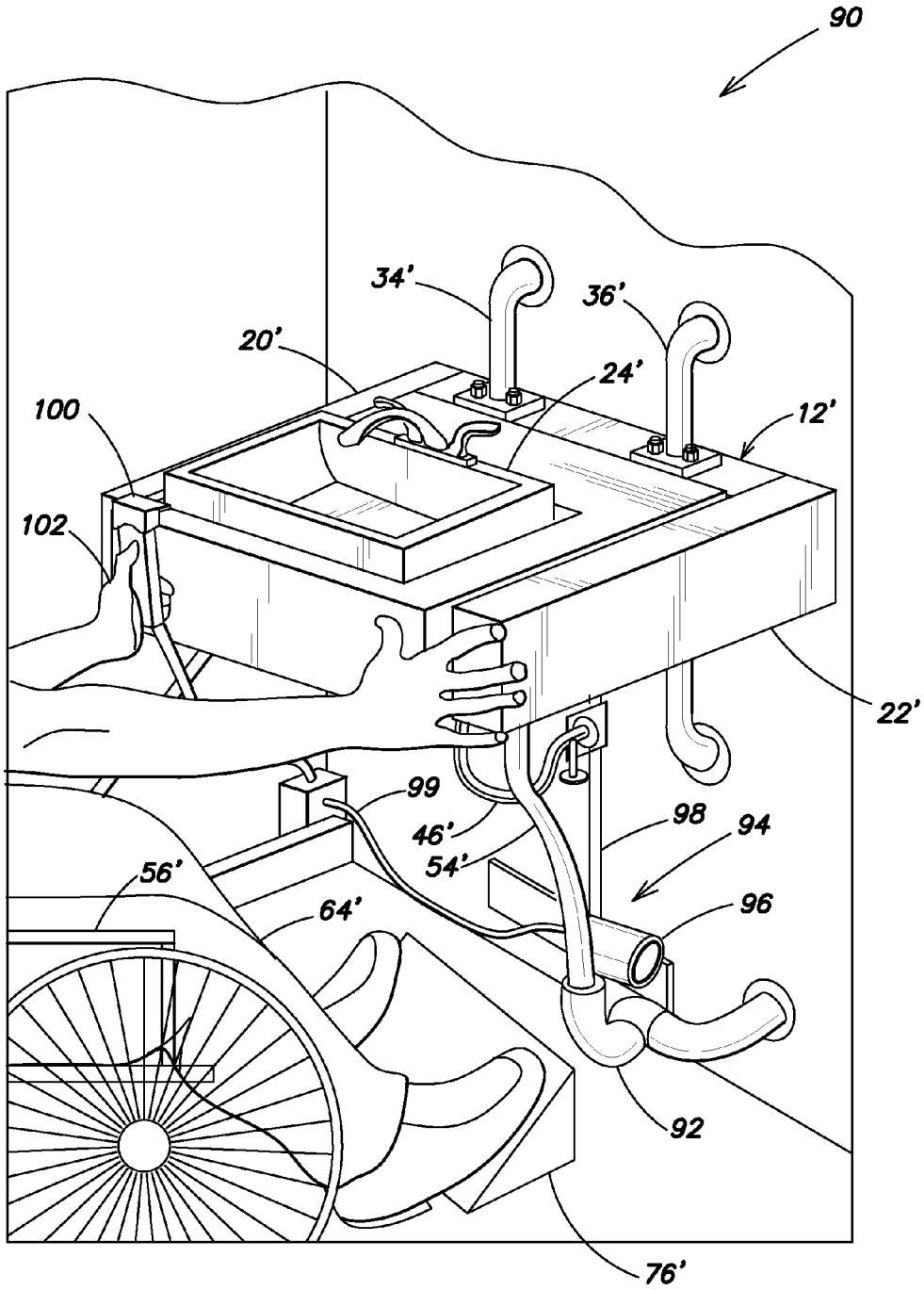
FIG. 2 is a fragmentary, raised perspective view of another embodiment of the vertically and horizontally adjustable sink system of the present disclosure, showing an exemplary vertical adjustment mechanism.

FIG. 2 shows a second embodiment 90 of the vertically and horizontally adjustable sink system 90. Components that are shown in the FIG. 2 embodiment 90 that are virtually identical to similar components in the FIG. 1 embodiment are show with the same reference numerals with primes (e.g., the sink in FIG. 2 is reference numeral 24') of the FIG. 1 reference numerals. FIG. 2 shows a sink 24' drain pipe 54' connected to a pivot trap 92 for ordinary flexible operation of the drain pipe 24'. More importantly, FIG. 2 shows an exemplary adjustable vertical mechanical connector 94 that includes an electrical motor 96 including a "rack and pinion" type of drive to force up and down a push-post 98. A control line 99 leads from the motor 96 to a hand-held control driver 100, shown in the hand 102 of the person 64' in the wheelchair 56'. The control driver 100 allows the person 64' to engage the motor 96 to selectively, vertically adjust the position of the sink 24' up and down along the slide-guide rails 34', 36'. It is to be understood that this exemplary adjustable vertical mechanical connector is but one of many apparatus that many comprise vertical mechanical connector means for selectively adjusting the vertical position of the sink 24'. Additional adjustable vertical connectors include any known apparatus that can perform the described function.

Figure 3:
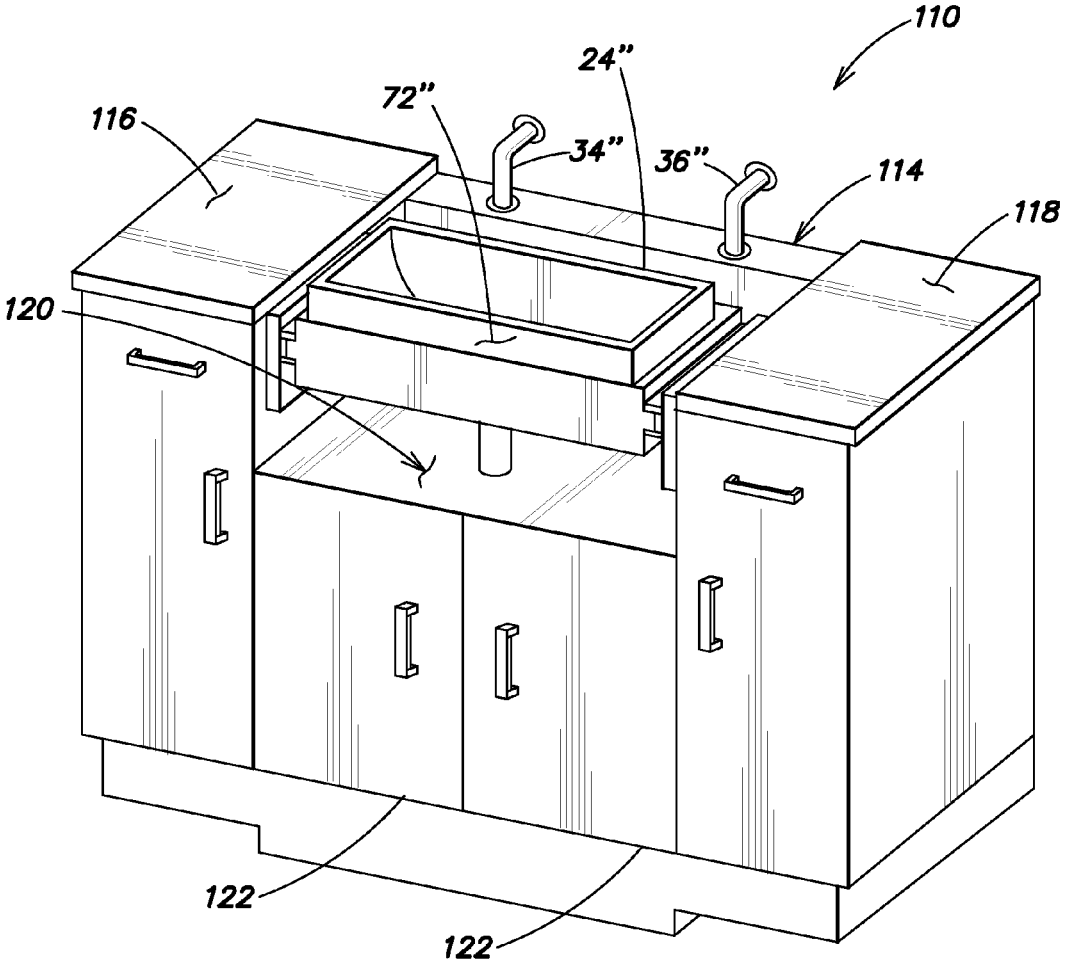
FIG. 3 is a front, raised perspective view of an embodiment of the vertically and horizontally adjustable sink system within a washroom cabinet and showing the sink in a first position flush with adjacent countertops of the cabinet.

FIG. 3. Shows an adjustable sink cabinet embodiment 110 of the vertically and horizontally adjustable sink system 110 (as with FIG. 2, virtually identical components will be shown in FIG. 3 as double primes of the same components in FIG. 1). The FIG. 3 embodiment 110 shows a vertically and horizontally adjustable sink 24" secured within an adjustable sink cabinet 114 that includes a first work surface 116 and a second work surface 118 secured on opposed sides of the adjustable sink 24". In the FIG. 3 drawing, he adjustable sink 24" is shown in an ordinary disposition to be flush with, or on about the same horizontal plane as, the two opposed work surfaces 116, 118. Additionally, the adjustable sink cabinet 114 includes an adjustment gap 120 below the front edge 72" of the sink 24" and above a cabinet door 122. The adjustment gap 120 defines a void of sufficient dimensions to permit vertical adjustment of the sink 24" into the gap through a vertical extension range 68 of at least ten inches.

Figure 4:
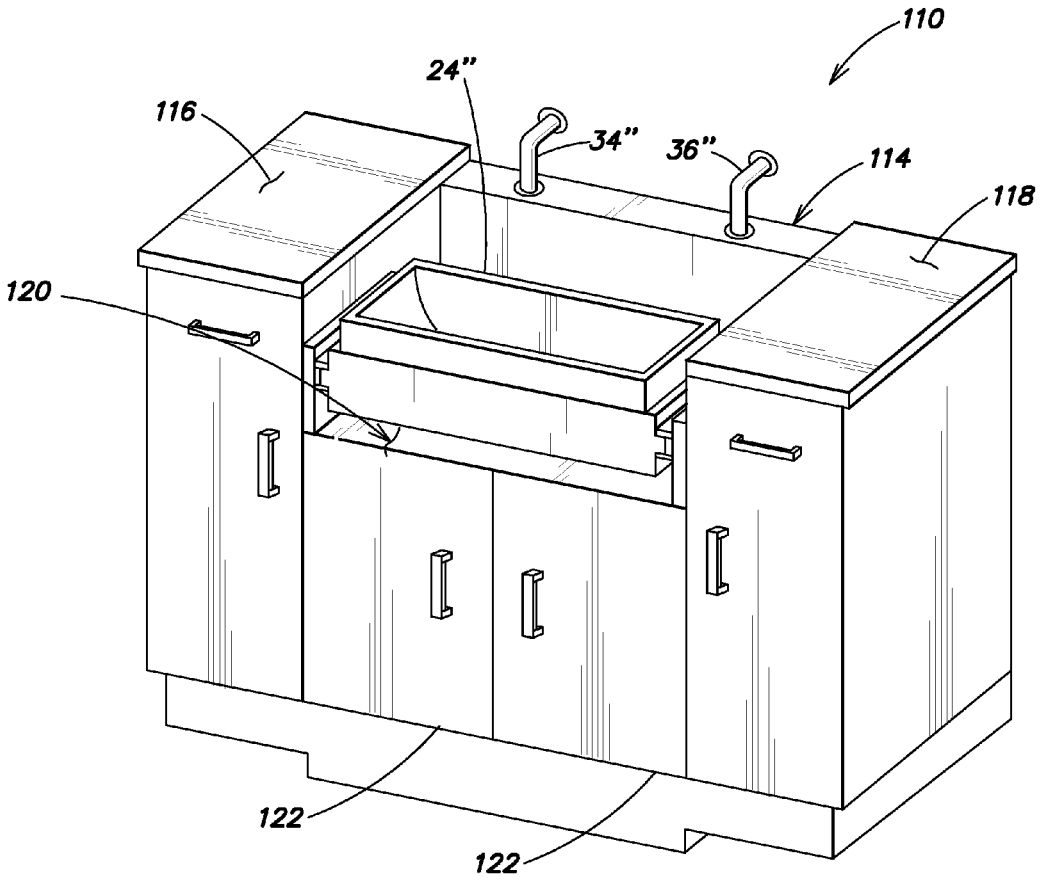
FIG. 4 is a front, raised perspective view of the FIG. 3 embodiment of the vertically and horizontally adjustable sink system within the washroom cabinet and showing the sink in a second position vertically lowered to be below adjacent countertops of the cabinet.
Figure 5:
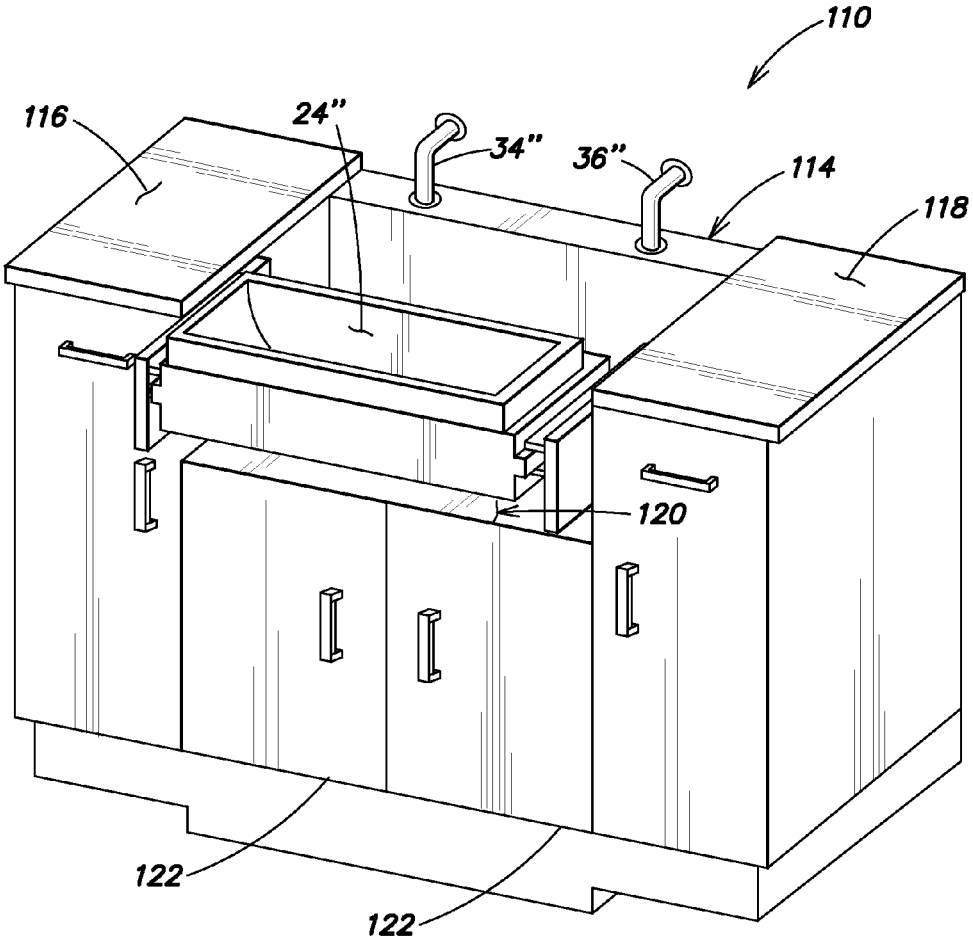
FIG. 5 is a front, raised perspective view of the FIG. 3 embodiment of the vertically and horizontally adjustable sink system within the washroom cabinet and showing the sink in a third position horizontally extended forward of adjacent countertops of the cabinet.
Figure 6:
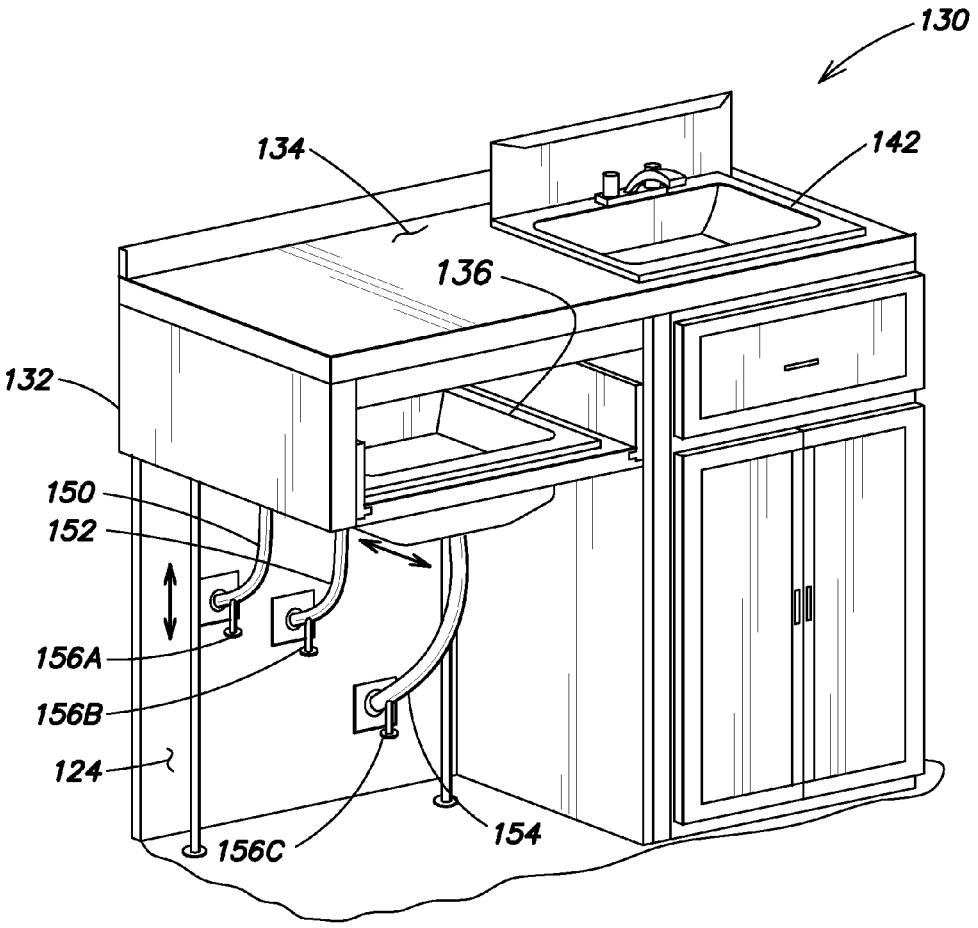
FIG. 6 is a raised, side perspective, of a two-sink cabinet embodiment of the vertically and horizontally adjustable sink system and showing a first vertically and horizontally adjustable sink disposed below a countertop of the cabinet and showing a second vertically and horizontally adjustable sink disposed within a void defined within the countertop of the cabinet.
Figure 7:
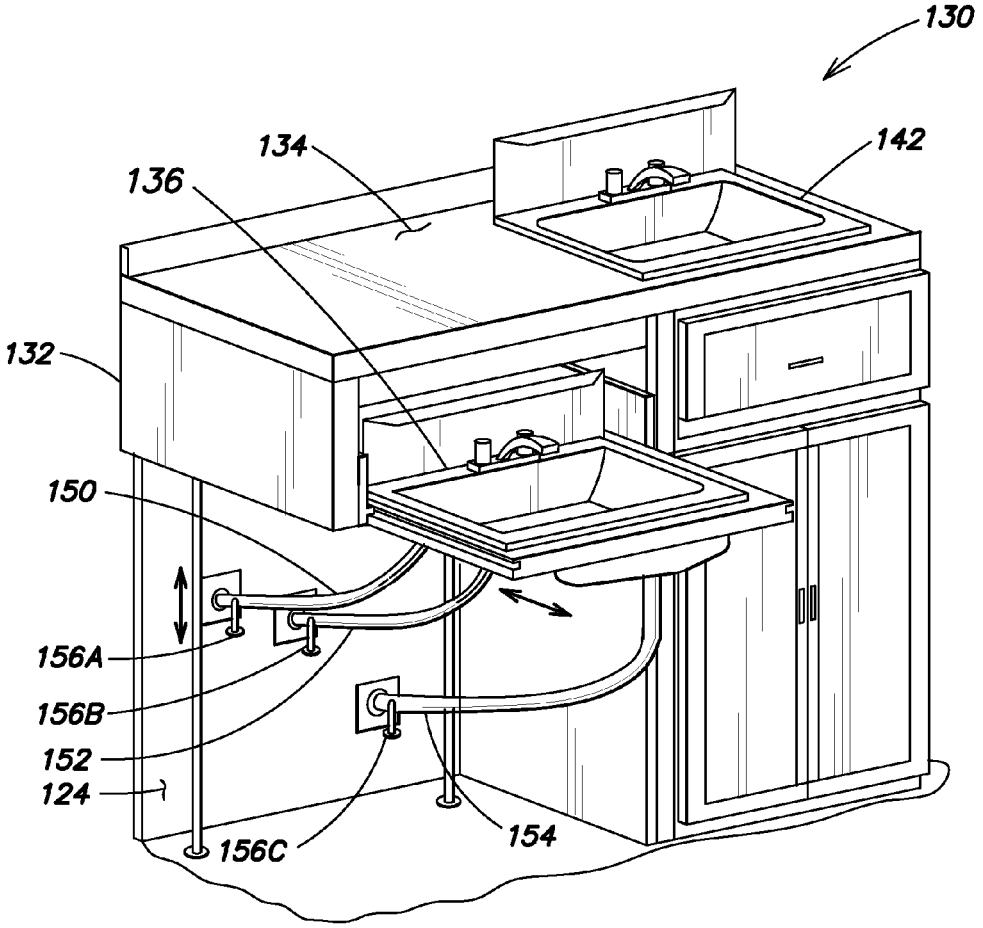
FIG. 7 is a raised, side perspective, of the two-sink cabinet embodiment of the vertically and horizontally adjustable sink system of FIG. 6 showing the first sink extended horizontally forward from the cabinet.
Figure 8:
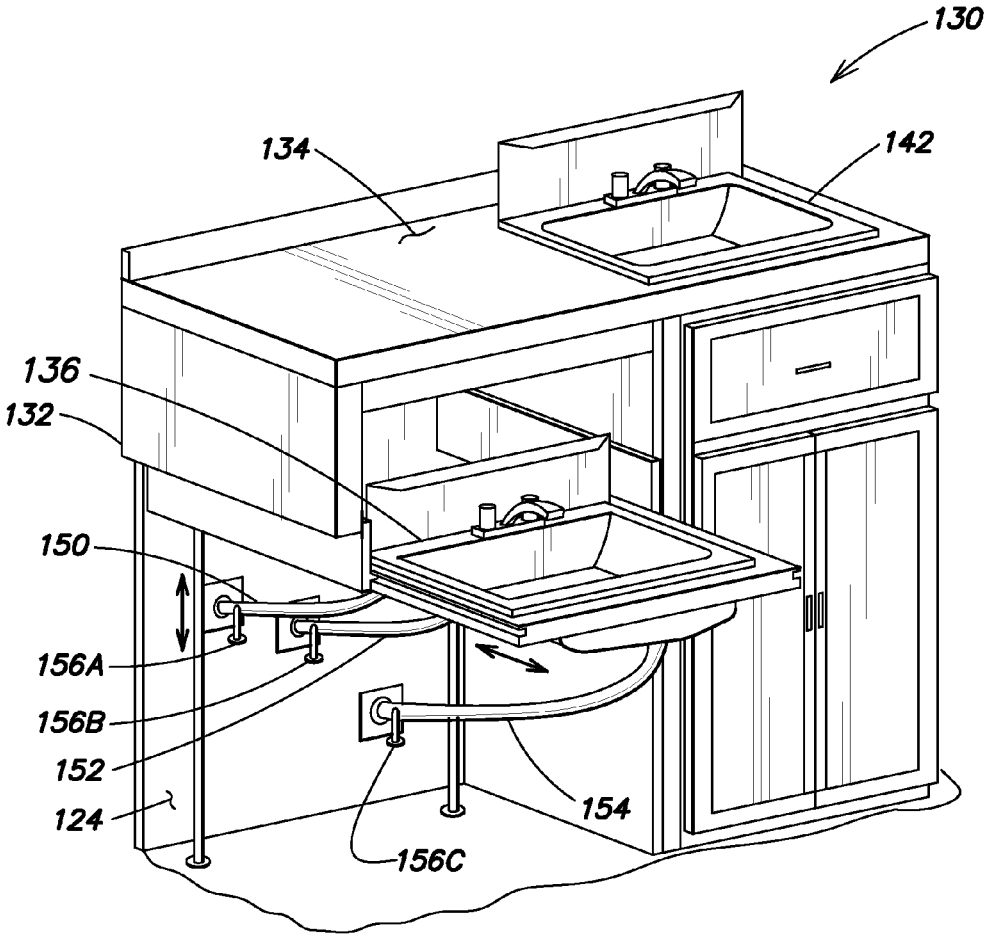
FIG. 8 is a raised, side perspective, of the two-sink cabinet embodiment of the vertically and horizontally adjustable sink system of FIG. 7 showing the horizontally extended first sink vertically lowered below the position of the first sink in FIG. 7.
Figure 9:
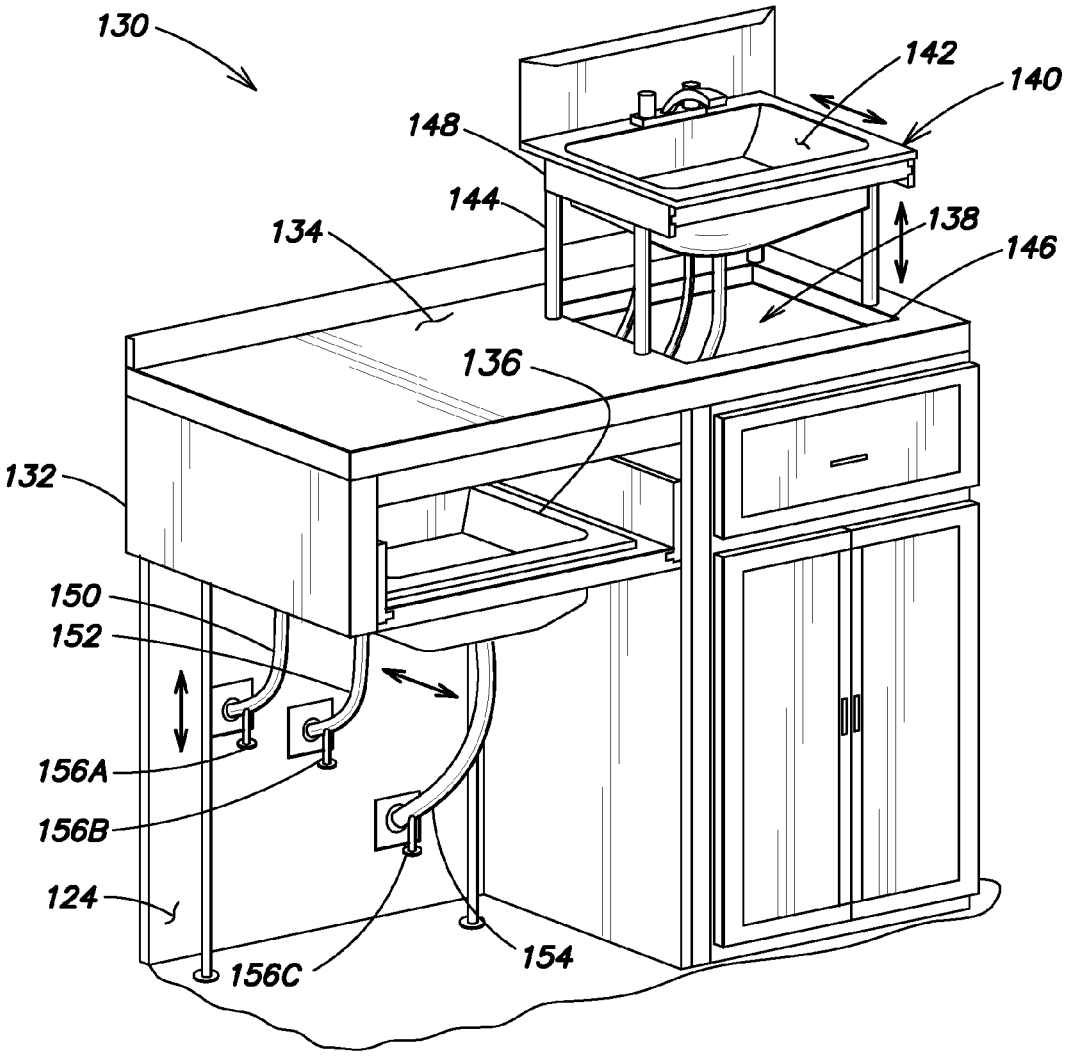
FIG. 9 is a raised, side perspective, of the two-sink cabinet embodiment of the vertically and horizontally adjustable sink system of FIG. 6, showing a second sink raised vertically above the cabinet countertop.
Figure 10:
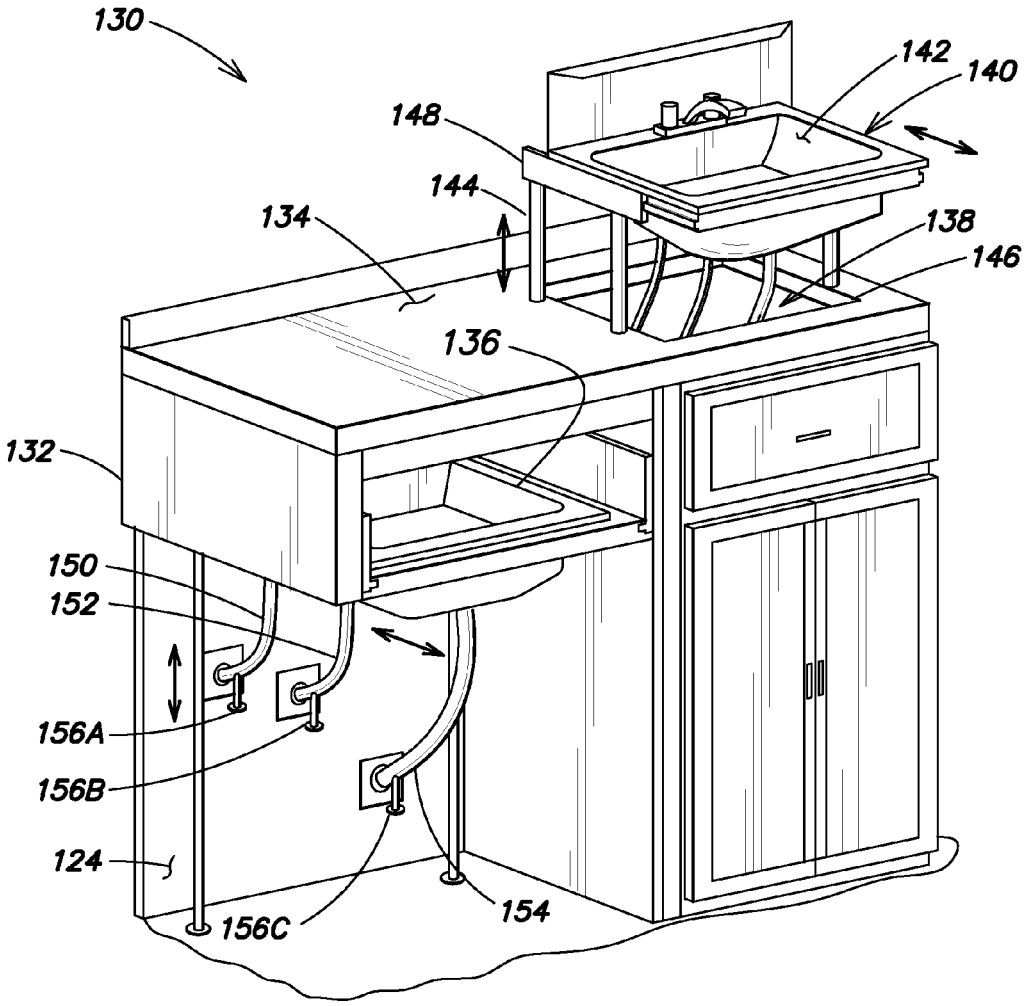
FIG. 10 is a raised, side perspective, of the two-sink cabinet embodiment of the vertically and horizontally adjustable sink system of FIG. 9, showing the second sink extending horizontally forward of the position of the second sink in FIG. 9.

FIG. 4 shows the FIG. 3 the adjustable sink cabinet embodiment 110 with the vertically and horizontally adjustable sink 24" vertically adjusted downward within the adjustment gap 120. FIG. 5 shows the adjustable sink cabinet embodiment 110 with the vertically and horizontally adjustable sink 24" horizontally adjusted outward away from the work surfaces 116, 118 without having been lowered as in FIG. 4. This deployment of the sink 24" may be appropriate for a user of a walker (not shown), or an individual not needing the sink lowered, but still limited in motion.

In the embodiments of the vertically and horizontally adjustable sink shown in FIGS. 3-10, the vertical adjustment mechanism 30 may be secured between the sink support frame 12 and a rear wall 124 of a sink-cabinet, such as a two-sink cabinet 130 shown in FIGS. 6-10. In the cabinet embodiments of FIGS. 3-5 and 6-10, the vertically and horizontally adjustable sink system 10 is integrated within a common bathroom cabinet or kitchen cabinet 110, 130 and the vertical adjustment mechanism 30 is anchored to a component of the cabinet, such as the rear wall 124 of the cabinet 130.

FIGS. 6-10 show the two-sink cabinet 130 of the vertically and horizontally adjustable sink system 130. In this embodiment, the sink support frame 12 described with reference to FIGS. 1 and 2 may be characterized as one of two adjustable sinks integrated within one cabinet 130. In this embodiment the above-described FIG. 1 sink support frame 12 is a first sink support frame 132 that is integrated within the two-sink cabinet 130. The two-sink cabinet 130 includes a horizontal countertop 134 that overlies the first sink support frame 132 and first sink 136 within the first frame 132. A portion of the horizontal countertop extends horizontally beyond the first sink support frame and defines a void 138 (seen best in FIGS. 9 and 10) for receiving and securing a second sink support frame 140 that supports a second sink 142.

A second vertical adjustment mechanism 144 is secured between the second sink support frame 140 and a frame component 146, such as opposed surfaces of the countertop 134 of the two-sink cabinet 130. The second vertical adjustment mechanism 144 may include the elements of the vertical adjustment mechanism 30 described above with reference to FIGS. 1 and 2 to permit selective vertical movement of the second sink support frame 140 vertically up and down above the horizontal countertop 134. Additionally, a second horizontal adjustment mechanism 148 is secured between the second sink support frame 140 and the second sink 142. The second horizontal adjustment mechanism 148 includes the elements of the horizontal adjustment mechanism 40 associated with FIG. 1 described above. The second horizontal adjustment mechanism 148 is configured to permit selective horizontal movement of the second sink 142 away from and toward the rear wall 124 of the two-sink cabinet 130 whenever the vertical adjustment mechanism 144 has positioned the second sink support frame 140 above the horizontal countertop 134. This facilitates use of the second sink by a person using a walker (not shown).

The two-sink cabinet 130 embodiment of the vertically and horizontally adjustable sink system 130 may include a flexible cold water delivery line 150, a flexible hot water delivery line 152 and flexible drain pipe 154 (shown only in FIG. 6) that are secured between the first sink 136 the rear wall 124 below the first sink support frame 132 by quick disconnect fittings 156A, 156B, 156C. Such quick disconnect plumbing fittings 156A, 156B, 156C are available from "PROBITE" brand "Quick Plumb Fittings" and can be seen at: http://www.probite.com/compare-push-connect-fittings.htm Use of the quick disconnect plumbing fittings 156A, 156B, 156C facilitates efficient installation and removal of the first sink 136 and first sink frame 132 for only a partial duration of use of the two-sink cabinet 130, such as when a washroom is used by an elderly or disabled person confined to a wheelchair for a few years, and therebefore or thereafter it is desired to use the space in the cabinet 130 for storage or other uses whenever the first sink support frame 132 is removed from the two-sink cabinet 130.

As described above, the adjustable vertical mechanical connector 30 and horizontal mechanical connecter 40 may include any apparatus known in the art that can accomplish the described functions of vertically and horizontally adjusting positions of the first sink frame 132 and second sink frame 140 and the first and second sinks 136, 142. For example, the vertical mechanical connector may include linear slides, threaded axle and screw mechanical linkages, or rack and pinion drives, etc. to vertically move the sink support frames 12, 132, 140 as described above.

Similarly, the horizontal mechanical connectors 40, 148 may include standard slides such as utilized in ordinary cabinet drawers, or other known horizontal adjustment apparatus that can accomplish the described functions. The vertical 30, 144 and horizontal mechanical connectors 40, 148 may also include electric-motors, hydraulic pumps, pneumatic compressors or combinations thereof, or other power generating apparatus with positioning sensor control systems (not shown) to permit automated movement of the sink support frames 12, 132, 140 and sinks 24, 136, 142 from a first position for non-disabled, young or short persons to second and/or other predetermined positions for elderly or disabled persons using wheelchairs 56 and/or walkers (not shown). For example, a control switch (not shown) near the sink support frames 12, 132, 140 may simply be actuated from a first position to a second position to adjust the sinks 24, 136, 142 between first and second predetermined positions, wherein the predetermined positions are established to meet the needs of specific persons including those using wheelchairs and/or walkers.

While the present disclosure has been presented above with respect to the described embodiments of the vertically and horizontally adjustable sink system 10, it is to be understood that the disclosure is not to be limited to those illustrations and described embodiments. Accordingly, reference should be made primarily to the following claims rather than the forgoing description ho determine the scope of the disclosure.

What is claimed is:

1. A vertically and horizontally adjustable sink system, the sink system comprising:

a. a sink support frame having a rear strut with a first edge and an opposed second edge at opposed perimeter edges of the rear strut, a first arm extending from the first edge away from the rear strut and a second arm extending away from the second edge of the rear strut, the rear strut, first arm and second arm being configured to support a sink between the rear strut, first and second arms and to support the sink within a plane about parallel to a plane defined by a floor below the sink support frame;

b. a vertical adjustment mechanism secured between the sink support frame and a rear wall, the rear wall being secured to define an approximate vertical plane above the support surface and adjacent the rear strut of the sink support frame, the vertical adjustment mechanism including an adjustable vertical mechanical connector secured between the rear wall and the sink support frame and configured to permit selective vertical movement of the sink support frame vertically up and down in an axis about parallel to the vertical plane of the rear wall;

c. a horizontal adjustment mechanism secured between the sink support frame and the sink, the horizontal adjustment mechanism including an adjustable horizontal mechanical connector secured between the sink support frame and the sink and configured to permit selective horizontal movement of the sink away from and toward the rear strut along a plane about parallel to the plane defined by the planar, horizontal support surface below the sink support frame; and, d. flexible cold and hot water delivery lines secured between the wall below the sink support frame and an inlet of at least one sink-top faucet, the inlet being on a bottom surface of the sink, and a flexible drain pipe secured between a drain outlet in the bottom surface of the sink and the wall below the rear strut.

2. The vertically and horizontally adjustable sink system of claim 1 further comprising:

a. the vertical adjustment mechanism being configured so that an upper surface of the sink selectively extends a vertical extension range of about ten inches above and about ten inches below a construction standard height of about thirty-six inches above the horizontal support surface;

b. the sink being configured so that whenever a back edge of the sink is adjacent the rear strut of the sink support frame, a front edge of the sink is within a vertical plane that defines a leading edge limit that prohibits motion of a leading edge of a wheel chair beyond the leading edge limit toward the rear strut of the sink support frame; and, c. the horizontal adjustment mechanism being configured so that a front edge of the sink selectively extends a horizontal extension range of about ten inches beyond the leading edge limit.

3. The vertically and horizontally adjustable sink system of claim 2, wherein the vertical adjustment mechanism is configured so that the upper surface of the sink selectively extends a vertical extension range of about twenty inches above and about twenty inches below the construction standard height of about thirty-six inches above the horizontal support surface.

4. The vertically and horizontally adjustable sink system of claim 2, wherein the horizontal adjustment mechanism is configured so that the front edge of the sink selectively extends a horizontal extension range of about twenty inches beyond the leading edge limit.

5. The vertically and horizontally adjustable sink system of claim 3, wherein the horizontal adjustment mechanism is configured so that the front edge of the sink selectively extends a horizontal extension range of about twenty inches beyond the leading edge limit.

6. The vertically and horizontally adjustable sink system of claim 2, wherein the vertical adjustment mechanism is configured so that the upper surface of the sink selectively extends a vertical extension range of about thirty inches above and about thirty inches below the construction standard height of about thirty-six inches above the horizontal support surface.

7. The vertically and horizontally adjustable sink system of claim 2, wherein the horizontal adjustment mechanism is configured so that the front edge of the sink selectively extends a horizontal extension range of about thirty inches beyond the leading edge limit.

8. The vertically and horizontally adjustable sink system of claim 6, wherein the horizontal adjustment mechanism is configured so that the front edge of the sink selectively extends a horizontal extension range of about thirty inches beyond the leading edge limit.

9. The vertically and horizontally adjustable sink system of claim 1, wherein the vertical adjustment mechanism is secured between the sink support frame and a frame component of a sink-cabinet.

10. The vertically and horizontally adjustable sink system of claim 1, further comprising the sink support frame being a first sink support frame integrated within a two-sink cabinet, the two-sink cabinet including a horizontal countertop overlying the first sink support frame, a portion of the horizontal countertop extending beyond the first sink support frame and defining a void for receiving and securing a second sink support frame that supports a second sink, wherein a second vertical adjustment mechanism is secured between the second support frame and a frame component of the two-sink cabinet, the second vertical adjustment mechanism including the elements of the vertical adjustment mechanism to permit selective vertical movement of the second sink support frame vertically up and down above the horizontal countertop, and wherein a second horizontal adjustment mechanism is secured between the second sink support frame and the second sink, the second horizontal adjustment mechanism including the elements of the horizontal adjustment mechanism to permit selective horizontal movement of the second sink away from and toward a rear wall of the two-sink cabinet whenever the vertical adjustment mechanism has positioned the second sink support frame above the horizontal countertop for use of the second sink by a person using a walker.

11. The vertically and horizontally adjustable sink system of claim 10, wherein the flexible cold and hot water delivery lines and the flexible drain pipe secured between the wall below the first sink support frame are secured to the wall by quick disconnect fittings.

12. The vertically and horizontally adjustable sink system of claim 1, wherein the adjustable vertical mechanical connector includes at least one of linear slides, mechanical linkages, and rack and pinion drives to vertically move the sink support frame.

13. The vertically and horizontally adjustable sink system of claim 1, wherein the adjustable vertical mechanical connector further comprises a motor configured to selectively vertically adjust positions of the sink support frame up and down along a first slide-guide rail and a second slide-guide rail, wherein both slide-guide rails pass through the rear strut of the sink support frame and both slide-guide rails are secured in parallel association with each other to the rear wall.

14. The vertically and horizontally adjustable sink system of claim 1, wherein the sink support frame is secured within an adjustable sink cabinet so that the adjustable sink is secured between a first work surface and a second work surface, wherein the adjustable sink cabinet defines an adjustment gap below the front edge of the sink and above a cabinet door extending from the adjustment gap to the support floor supporting the adjustable sink cabinet, and wherein the adjustment gap defines a void of sufficient dimensions to permit vertical adjustment of the sink from adjacent the first and second work surfaces into the adjustment gap through a vertical extension range of at least ten inches below the first and second work surfaces while the sink remains above the cabinet door.

* * * * *